US006644989B2

(12) United States Patent
Robinson

(10) Patent No.: US 6,644,989 B2
(45) Date of Patent: Nov. 11, 2003

(54) ELECTRICAL SERVICE APPARATUS WITH LIGHT TRANSMISSION GUIDE

(75) Inventor: Darrell Robinson, Highland, MI (US)

(73) Assignee: Ekstrom Industries, Inc., Farmington Hills, MI (US)

( * ) Notice: Subject to any disclaimer, the term of this patent is extended or adjusted under 35 U.S.C. 154(b) by 0 days.

(21) Appl. No.: 10/231,972

(22) Filed: Aug. 30, 2002

(65) Prior Publication Data

US 2002/0197896 A1 Dec. 26, 2002

Related U.S. Application Data

(60) Division of application No. 09/773,064, filed on Jan. 31, 2001, which is a continuation-in-part of application No. 09/773,064, filed on Jan. 31, 2001, now Pat. No. 6,478,589.

(51) Int. Cl.[7] ..... H01R 13/44

(52) U.S. Cl. ..... 439/146; 439/490; 439/517

(58) Field of Search ..... 439/490, 146, 439/517

(56) References Cited

U.S. PATENT DOCUMENTS

| | | | | |
|---|---|---|---|---|
| 1,645,539 A | | 10/1927 | Mau | 439/866 |
| 3,061,763 A | | 10/1962 | Ekstrom | 361/669 |
| 3,221,216 A | | 11/1965 | Kobryner | 361/704 |
| 3,352,277 A | | 11/1967 | Schmidt | |
| 3,662,224 A | | 5/1972 | Rauch | 361/741 |
| 3,794,428 A | | 2/1974 | Giesecke | |
| 4,127,924 A | | 12/1978 | Ross | 29/413 |
| 4,151,747 A | | 5/1979 | Gottlieb et al. | |
| 4,412,714 A | | 11/1983 | Morningstart et al. | 439/352 |
| 4,491,789 A | * | 1/1985 | Benbow | 324/113 |
| 4,491,791 A | | 1/1985 | Balch et al. | |
| 4,491,792 A | | 1/1985 | Bullock et al. | |
| 4,491,793 A | | 1/1985 | Germer et al. | |
| 4,772,213 A | | 9/1988 | Bell et al. | 439/135 |
| 4,800,466 A | | 1/1989 | Bauer et al. | |
| 4,862,141 A | | 8/1989 | Jordal | |
| 4,892,485 A | | 1/1990 | Patton | 439/135 |
| 4,931,885 A | | 6/1990 | Mester et al. | |
| 5,023,747 A | | 6/1991 | Lindsay | 361/117 |
| 5,027,056 A | | 6/1991 | Russillo, Jr. et al. | |
| 5,057,767 A | | 10/1991 | Keturakis et al. | |
| 5,068,962 A | | 12/1991 | Germer et al. | 29/830 |
| 5,088,004 A | | 2/1992 | Howell | 361/373 |
| 5,145,403 A | | 9/1992 | Schaffert et al. | 439/508 |
| 5,268,633 A | | 12/1993 | Balch | |
| RE34,531 E | | 2/1994 | Bell et al. | 439/135 |
| 5,390,065 A | | 2/1995 | Allina et al. | |
| 5,423,695 A | | 6/1995 | Robinson et al. | 439/517 |
| 5,571,031 A | | 11/1996 | Robinson et al. | 439/517 |
| 5,572,386 A | * | 11/1996 | Ananth et al. | 360/103 |
| 5,577,933 A | | 11/1996 | Robinson et al. | 439/517 |
| 5,586,913 A | | 12/1996 | Robinson et al. | 439/638 |
| 5,596,468 A | * | 1/1997 | Allina | 361/56 |
| 5,704,804 A | | 1/1998 | Robinson et al. | 439/517 |
| 5,742,512 A | | 4/1998 | Edge et al. | |
| 5,851,038 A | | 12/1998 | Robinson et al. | |
| 6,081,180 A | * | 6/2000 | Fernandez et al. | 336/90 |
| 6,152,764 A | * | 11/2000 | Robinson et al. | 439/517 |
| 6,325,666 B1 | * | 12/2001 | Robinson et al. | 439/517 |

OTHER PUBLICATIONS

Opic Guard Protective Cover, Kansas City Power & Light Co., Published May 8, 2001 Only 3 Pages.

Marwell socket adapter with internal wire clips and Edco telephone connection by Liebert Corp., Model No. FAS–TEL–200T Only 1 Page.

* cited by examiner

*Primary Examiner*—Tho D. Ta
*Assistant Examiner*—James R. Harvey
(74) *Attorney, Agent, or Firm*—Young & Basile, PC

(57) ABSTRACT

A light transmissive guide transmits light bidirectionally between a first end disposed interiorly of an electrical power service apparatus housing and a second end visible externally of the housing. The transmitted light by the light guide can be a status light of a device mounted within the housing or light forming part of an optical data communication signal transmitted bidirectionally between light operative and/or responsive devices mounted internally within the housing and similar devices disposed in light communication with the external end of the light guide.

18 Claims, 11 Drawing Sheets

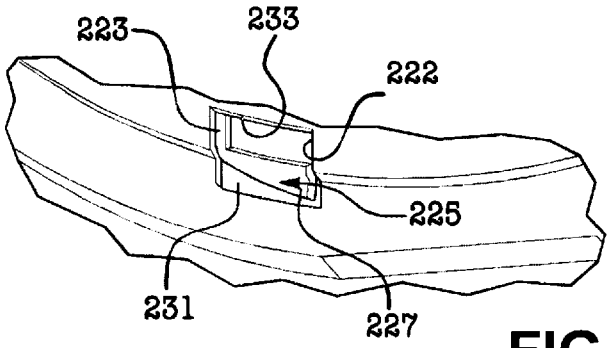
FIG - 12C
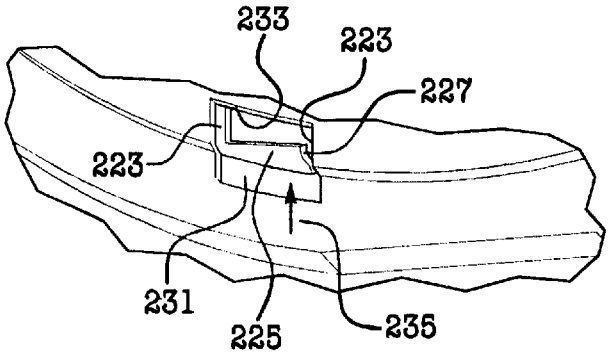
FIG - 12D
FIG - 13
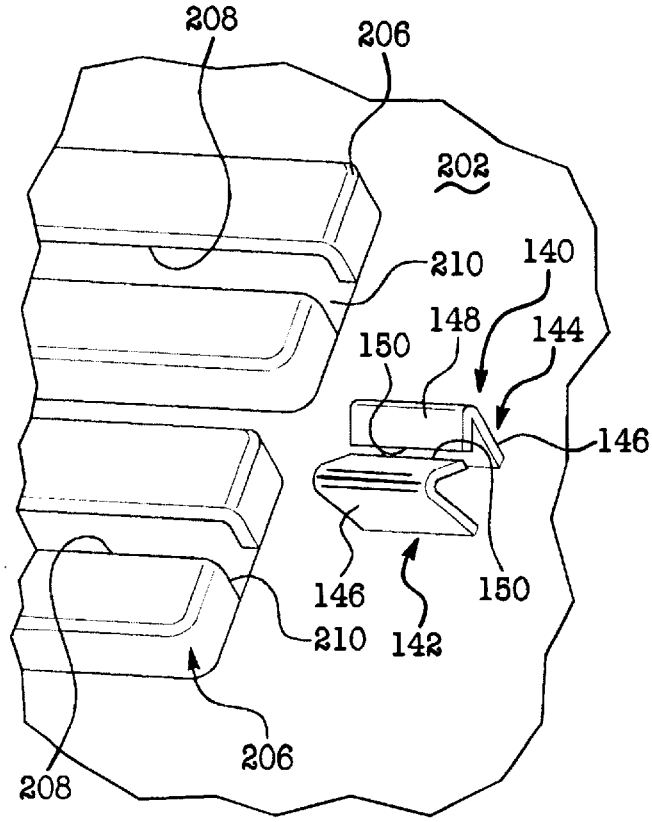

ELECTRICAL SERVICE APPARATUS WITH LIGHT TRANSMISSION GUIDE

CROSS REFERENCE TO CO-PENDING APPLICATION

This application is a division and a continuation-in-part of application Ser. No. 09/773,064, filed Jan. 31, 2001 now U.S. Pat. No. 6,478,589 and entitled Electrical Service Apparatus Safety Shield with Wire Guides, the entire contents of which is incorporated herein in its entirety.

BACKGROUND

1. Field of the Invention

The present invention relates, in general, to electrical power service to homes and buildings and, more specifically, to watthour meters, meter sockets and watthour meter socket adapters.

2. Description of the Art

Electrical power is supplied to an individual site or service by electrical power line conductors located above or below ground. In a conventional arrangement, electrical power line conductors are connected to contacts in a watthour meter socket mounted on a building wall. Electrical load conductors are connected to another set of contacts in the meter socket and extend to the electrical distribution network in the building. A watthour meter, typically of the plug-in, socket type, is connected to the contacts in the meter socket to measure the electrical power drawn through the load conductors.

Plug-in watthour meter socket adapters and socket adapters/extenders, both hereafter referred to simply as socket adapters, are designed to plug into the meter socket housing contacts. Such socket adapters are employed to convert ringless style sockets to ring style sockets or to extend the mounting position of the jaw terminals in the socket housing outward from the socket housing for mounting various electrical equipment, such as test devices or survey recorders, in the socket housing.

Such socket adapters employ a generally annular base having a shell joined thereto and extending outward from one side of the base. Contacts are mounted in the shell and base. Each contact has a female jaw portion disposed interiorly within the shell and a male blade terminal connected to the female jaw portion and extending outward from the shell and the base for a plug-in connection to the terminals in the meter socket housing.

While it is typical for a watthour meter, once it is installed in a socket or socket and socket adapter, to remain in service for many years, it is still necessary for such meters to be removed for repair or replacement from time to time as well as to temporarily disconnect electrical service to a particular customer. During the installation and removal of the watthour meter from the socket or socket adapter, the electric power line terminals in the socket or socket adapter remain connected to the electric utility power line conductors and carry potential. The utility employee installing or removing the watthour meter may inadvertently touch such contacts thereby raising the possibility of injury. Furthermore, an inadvertent short across the contacts caused by a tool contacting the contacts or a full fault caused by a 90° offset insertion of the meter can cause a spark or flash which could damage the watthour meter installation as well as posing a significant risk of injury to the utility employee.

In U.S. Pat. No. 5,577,933, a unique safety shield for a watthour meter mounting apparatus is disclosed which completely covers all of the exposed portions of the jaw contacts to prevent inadvertent contact with such contacts by the utility employee or by a tool.

One embodiment of this safety shield is in the form of a housing having a unitary sidewall and top wall defining a closed body with an internal recess surrounding the jaw contacts. Narrow apertures or slots are formed in the top wall for receiving the blade terminals of a watthour meter therethrough into engagement with jaw contacts disposed immediately below each aperture in the top wall of the safety shield. In another embodiment, a plurality of receptacles extend from a planar wall mountable in the socket adapter, with each receptacle having one or more slots for receiving the meter blade terminals therethrough. The individual receptacles are sized to completely surround at least one jaw contact in the socket adapter.

Improved versions of Applicants' safety shield as shown in U.S. Pat. Nos. 5,572,386, 5,577,933 and 6,325,666. These safety shields have been designed for a snap-in connection to the socket adapter base by means of legs having clip end portions which snap through apertures formed in the base wall of the socket adapter housing.

In certain electrical service apparatus or electric watthour meter socket adapter applications, the status or state of certain devices mounted interiorly within the housing of the socket adapter, such as the conductive or non-conductive state of surge suppression devices, such as MOVs, must be communicated exteriorly of the socket adapter housing to enable a service person to easily determine the operative or inoperative state of such devices without removing the watthour meter from the socket adapter.

Previously, wires from signal generating devices on circuit boards within the meter or adapter housing were connected to light bulbs mounted in the sidewall of the housing. This, however, has increased labor and added additional components to the meter or socket adapter. The wire, if broken, also resents an electrical hazard to anyone coming in contact with the wire or when the wire is wet.

It is also known in watthour meters to provide an optocoupler on the face or dome of the meter to enable a light generating programmer to be coupled to the exterior end of the optocoupler for communicating optical data signals to and from meter electronics. In this structure, the optocoupler represents a separate device which is physically mounted on the dome of the meter for optical communication through the dome.

It would be desirable to provide an electrical power service apparatus which has a light transmissive guide for establishing an optical communication path between interior mounted components and the exterior of the electrical power service apparatus which can be easily and economically mounted in the housing of the electrical power service apparatus without the need for additional wiring.

SUMMARY OF THE INVENTION

The present invention is an improved electrical service apparatus with a light transmission guide.

In one aspect of the invention, the light transmissive means or guide is mounted on or attached to a jaw contact safety shield. This enables integral mounting of the light transmissive guide in the desired position in the electrical service apparatus at the same time as the safety shield is mounted in the apparatus.

In one aspect, the light transmissive means or guide has first and second ends, the first end adapted to be disposed in proximity with a light generating source and/or light receptive element within the socket adapter to transmit light generated by the light generating source to the second end of the light guide or from the second end to the first end. Preferably, the second end of the light transmissive means is disposed through or visible through an aperture in the sidewall of the socket adapter housing for external access.

In another aspect, the light transmissive guide is formed as a separate element which is usable separately or in combination with a jaw contact safety shield, or mounted in the electrical service apparatus separate from any optional safety shield from the optional safety shield. For example, one or more inlet ends of a light transmissive means or guide, each disposed in light coupling arrangement with a separate light source are operative to transmit light from the respective light source to a common outlet which is visible exteriorly of the housing of the electrical service apparatus. In this aspect, the outlet end of the light transmissive means or guide is fixedly mounted in an aperture formed in a sidewall of the housing of the electrical service apparatus. The reverse direction of light transmission from the outlet end to one or both of the first inlets.

The present invention adds new functionality to electrical service apparatus. The unique light transmissive means or guide of the present invention uniquely enables light generated by a light generating source, such as an LED, in a functional circuit mountable within the socket adapter, to be transmitted to a more easily visible position, such as externally of the socket adapter. This enables the function indicated by the light generating source to be easily detected exteriorly of the socket adapter without requiring removal of the socket adapter from the watthour meter socket. At the same time, light from an external light source can be transmitted through the light guide to a light receptive element within the housing.

BRIEF DESCRIPTION OF THE DRAWINGS

The various features, advantages, and other uses of the present invention will become more apparent by referring to the following detailed description and drawing in which:

FIG. 12C is a partial, enlarged, perspective view of one latch projection of the safety shield depicted in the fully latched position;

FIG. 12D is a partial, enlarged, perspective view of one latch projection in a partial, unlatched position;

FIG. 13 is a partial, enlarged, perspective view of an alternate wire wrap means according to the present invention;

DETAILED DESCRIPTION

In order to better describe and appreciate the advantages of the present invention, a description of the construction of an electric service apparatus in the form of a watthour meter socket adapter or socket extender/adapter, both hereafter referred to as a socket adapter 10, will be provided with reference to FIGS. 1–9. It will be understood that the term "electrical service apparatus" as used in connection with the present invention means any type of apparatus used to provide, monitor or control electrical power to a use site. Thus, although the following description of the use of the safety shield of the present invention is in connection with a watthour meter socket adapter, it will be understood that the present safety shield is usable in any electrical service apparatus, including watthour meter sockets, etc.

Figure 1:
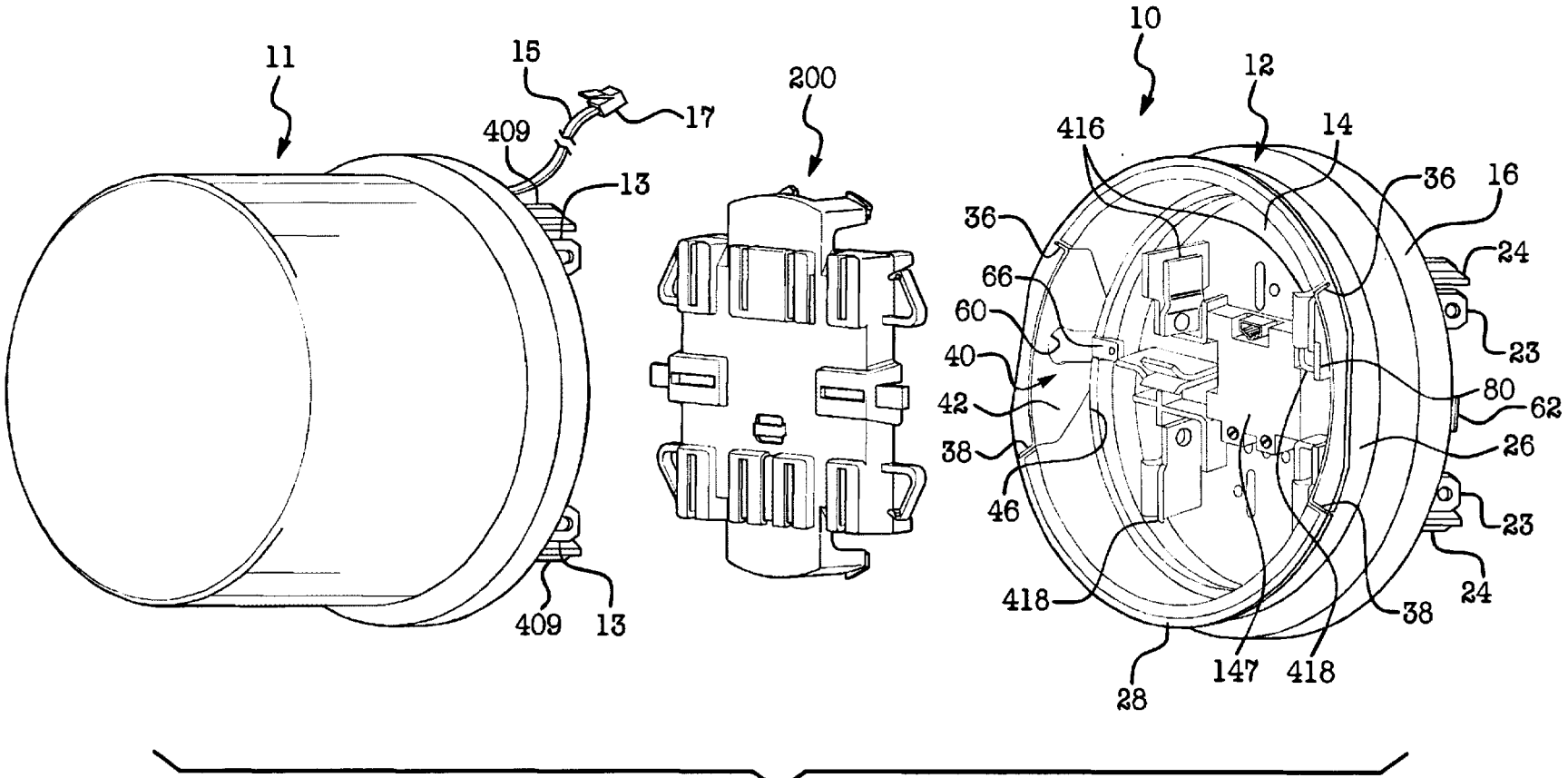
FIG. 1 is an exploded perspective view showing a safety shield constructed according to the teaching of the present invention mountable in a watthour meter socket adapter devised for receiving a watthour meter.

A conventional socket adapter 10 includes contacts designed to receive blade terminals 13 of a conventional electric watthour meter 11 in a releasible connection. The socket adapter 10 also includes terminals 23, described hereafter, which plug into mating contacts in a watthour meter socket, not shown. The number of contacts and terminals in the socket adapter 10 will vary depending upon the type of electric service at a particular user site, FIG. 1 depicts, by way of example only, a single phase electric service. Preferably, the socket adapter 10 includes a housing 12 which is integrally molded from a suitable electrically insulating material, such as polycarbonate.

The housing 12 includes a base 14 with a peripheral flange 16. A plurality of apertures 18, are formed in the base 14 by convention, at the jaw contact positions in a socket adapter 10. Mounting feet 24 extend from the outer surface of the base 14 and are disposed adjacent to the blade terminals 23.

An annular sidewall 26 extends from the base 14 to an outer meter mounting flange 28. The height or length of the sidewall 26 is substantially shorter than in previously devised socket adapters to provide a low profile to the socket adapter 10.

Figure 2:
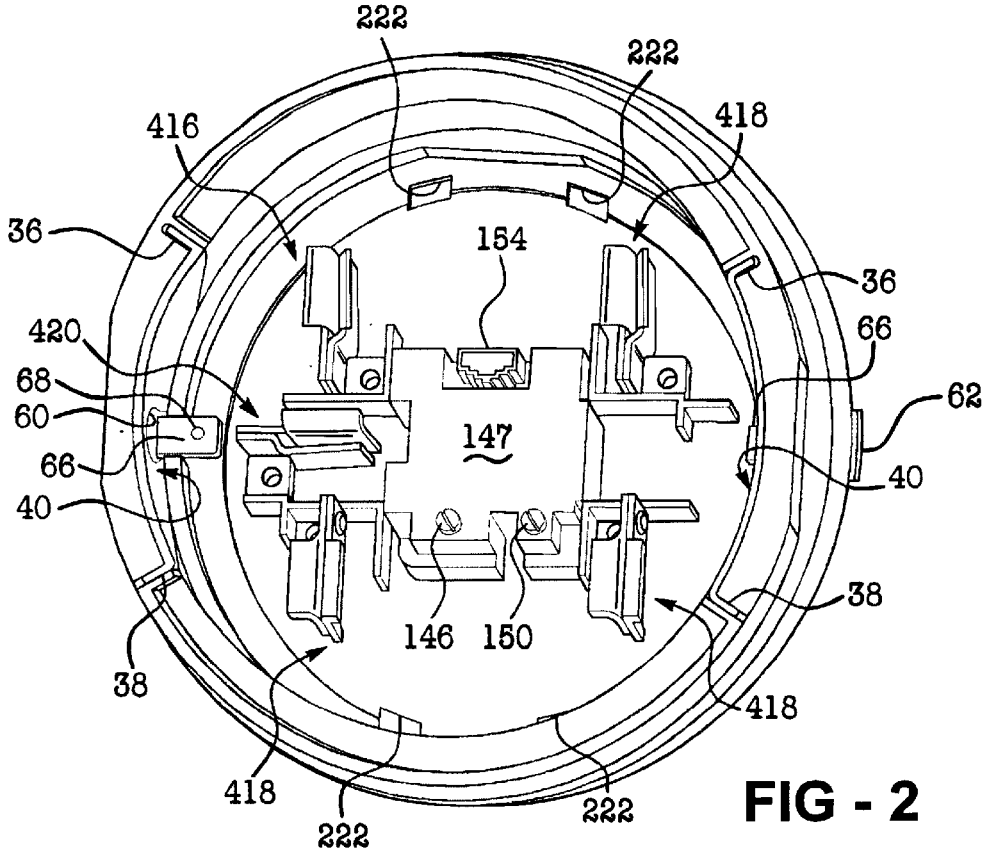
FIG. 2 is a perspective view of the socket adapter shown in FIG. 1 which receives the safety shield of the present invention.

The socket adapter 10 also has a ground surge means mounted therein. As shown in FIGS. 1 and 2, at least one pair of slots 36 and 38 are formed in the mounting flange 28. The slots 36 and 38 are spaced apart on the mounting flange 28 and extend from an inner edge of the mounting flange 28 at the juncture of the inner surface of the mounting flange 28 and the sidewall 26 to a termination short of the peripheral edge of the mounting flange 28. In a preferred embodiment, two pairs of slots 36 and 38 are formed on the mounting flange 28, each pair of slots 36 and 38 generally diametrically opposed from the other pair of slots 36 and 38 as shown in FIGS. 1 and 2.

At least one and preferably two identical surge ground conductors 40 are diametrically mounted opposite each other on the mounting flange 28. Each surge ground conductor 40 is removably mounted in one pair of slots 36 and 38 and includes an arcuate wall portion 42 which conforms to the inner diameter of the annular sidewall 26 of the housing 12. The arcuate wall portion 42 has an upper edge 44 and a lower edge 46. A pair of radially extending tabs are formed on opposite side ends of the arcuate wall portion 42 generally adjacent the upper edge 44. Each tab has a lower edge which seats in a lower portion of one of the slots 36 and 38 on the mounting flange 28. Each tab has an upper edge extending at an angle away from a planar lower edge to dispose the top edge 44 of each surge ground conductor 40 slightly above the upper edge of the mounting flange 28. This places the upper edge of each surge ground conductor 40 at a position to electrically engage a ground terminal mounted on the rear surface of a conventional watthour meter.

Each surge ground conductor 40, as shown in FIGS. 1 and 2, has a cutout 60 formed in the lower edge 46. As described in U.S. Pat. No. 5,997,345, the contents of which are incorporated herein in its entirety, a movable mounting foot or tab 62 is pivotally connected by fingers to the lower edge 46 of the arcuate wall portion 42. The mounting foot 62 has a generally planar shape. Opposite from the mounting foot and contiguous therewith is a second planar portion or flange 66 having an optional aperture 68 formed therein.

In an initial, premounted state, the mounting foot and contiguous flange 66 are generally in-line with the annular sidewall 42 of each surge ground conductor 40. The mounting foot is designed to be slidably inserted through an aperture formed at the juncture of the base 14 and the annular sidewall 26 of the socket adapter housing 12. Two slots are diametrically formed in the housing 12. One mounting foot is inserted through one slot after being bent generally perpendicular to the annular sidewall 42 until the foot is disposed in proximity with the base 14 of the housing 12 to securely attach each surge ground conductor 40 to the housing 12.

At the same time, the pivotal or bending movement of the mounting foot also causes a pivotal movement of the flange 66 to a radially inward extending position within the housing 12. In this position, the flange 66 is located to provide an easy connection with an electrical conductor to connect the electrical conductor to the surge ground conductor 40. Further, the flange 66 is preferably configured to receive a slide-on, quick connector attached to one end of an electrical conductor. By use of the integral mounting fpot 62, each surge ground conductor 40 may be securely attached to the socket adapter housing 12 without the need for a separate fastener, rivet, etc.

As described in detail in U.S. Pat. No. 6,152,764, the contents of which are incorporated herein in its entirety and as shown in FIGS. 1, 3–9, the base 14 of the socket adapter 10 is of generally circular shape. Preferably, the apertures or slots 18 having an elongated, rectangular shape suitable for receiving the blade terminal of a jaw blade assembly as described hereafter.

As best seen in FIG. 1, the outer end of the sidewall 26 terminates in a radially outward extending mounting flange 28 which is adapted for mating with a complementary mounting flange on a watthour meter. The mounting flange 28 is surroundable by a conventional sealing ring, not shown, to sealingly join the watthour meter 11 to the socket adapter 10 in a conventional manner.

For the single phase socket adapter 10 shown in FIGS. 1 and 2, a pair of line jaw blades 416 and a pair of load jaw blades 418 are mounted in the base 14 in the appropriate jaw contact/blade terminal positions for a single phase watthour meter/watthour meter socket application. A similar jaw blade 420 may also be provided at the fifth position.

As each of the line, load and ground or fifth position jaw blades 416, 418 and 420 are substantially identically constructed, the following description of a first embodiment of the jaw blade 416, as shown in FIGS. 4–7, will be understood to apply equally to all line, load and ground jaw blade assemblies.

Figure 5:
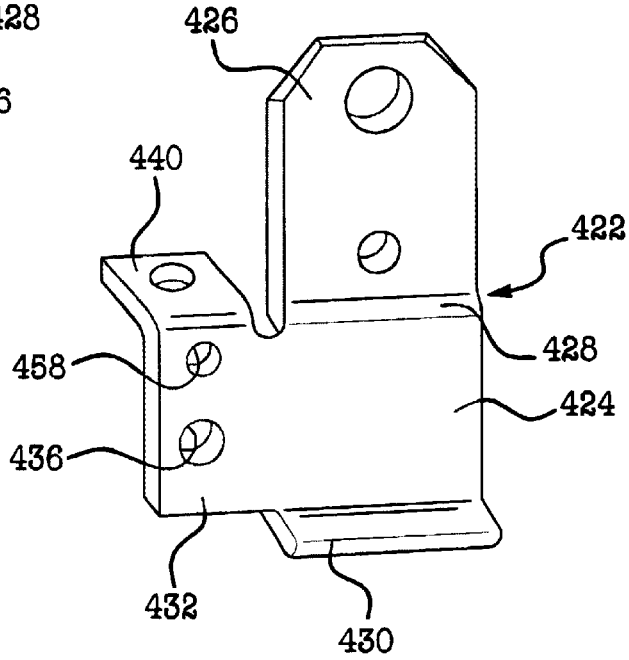
FIG. 5 is a perspective view of the bus bar portion of the jaw blade shown in FIG. 4.

As shown in FIG. 5, the jaw blade 416 includes a one piece, unitary, electrically conductive bus bar 422 which is formed with a jaw end 424 and an opposed blade terminal end 426. The bus bar 422 is formed of an electrically conductive material, such as copper, or plated copper for example. An offset 428 is formed intermediately between the jaw end 424 and the blade terminal end 426 to offset the plane of the jaw end 426 from the plane of the blade terminal end 426.

An angled edge guide 430 is formed along one edge of the jaw end 424 to assist in guiding a watthour meter blade terminal, not shown, into contact with the jaw end 424 as described hereafter. An extension 432 projects unitarily from the jaw end 424 co-planarly with the jaw end 424. The extension 432 serves as a mounting base for a spring clip 434 described in greater detailed hereafter. An aperture 436 is formed in the extension 432 for receiving a fastener, such as a rivet 438, used to mount the spring clip 434 on the bus bar 422.

A tab 440 projects angularly, preferably perpendicularly, from one edge of the extension 432. The tab 440 is positioned intermediate the jaw end 424 and the blade terminal end 426 of the bus bar 422 and also extends generally perpendicularly from the jaw end 424 and the blade terminal end 426. An aperture 442 may be formed in the tab 440 for receiving a fastener, not shown, to secure an auxiliary electrical conductor, not shown, to the tab 440 and jaw blade 416. However, the tab 440 serves a more important mounting function for the jaw blade assembly 416 as described hereafter.

Figure 6:
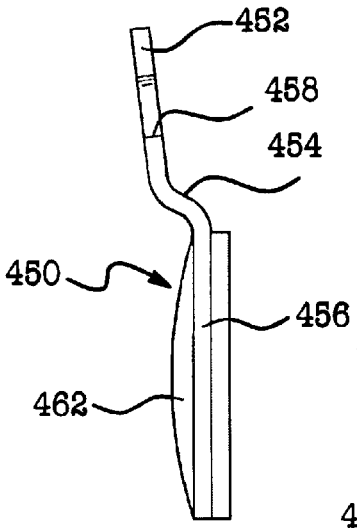
FIG. 6 is a side elevational view of the spring clip shown in FIG. 4.
Figure 7:
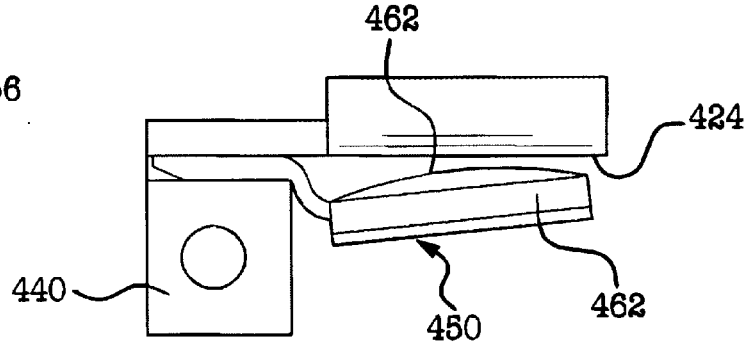
FIG. 7 is a plan elevational view of the assembled jaw blade shown in FIG. 4.

As shown in FIGS. 6 and 7, the jaw blade 416 also includes a spring clip 450 which is formed of a spring or resilient material, such as spring steel. The spring clip 450 includes a base 452 which is connected by an intermediate, offset 454 to a contact end 456.

The base 452 is initially pre-bent from a planar adjacent the offset 454, as shown in FIG. 6. An aperture 458 in the base 452 receives the fastener or rivet 438. Insertion of the rivet 438 through the aperture 458 and the corresponding aperture 436 in the extension 432 on the bus bar 422 bends end of the base 452 into planar, full contact engagement with the extension 432 to apply spring force to the spring clip 450.

The single fastener or rivet 438 can be employed to fixedly mount the spring clip 450 on the bus bar 422 since a centering and locating dimple 458 and mating dome 460 are respectively formed in the bus bar 422 at the juncture between the extension 432 and the tab 440 and on one side edge of the base 452 of the spring clip 450. The engagement of the dimple 458 and the dome 460 locates the spring clip 450 with respect to the bus bar 422 and prevents rotation of the spring clip 450 relative to the bus bar 422 after the rivet 438 is inserted to fixedly attach the spring clip 450 to the bus bar 422.

As shown in FIGS. 6 and 7, the contact end 456 of the spring clip 450 has a generally concave shape with a raised center contact surface 462 facing the adjacent jaw end 424 of the bus bar 422. Since the forced engagement of the rivet 438 with the angled base 452 of the spring clip 450 places a spring force on the spring clip 450 biasing the contact end 456 toward the adjacent jaw end 424, the raised center 462 of the contact end 456 forms an adequate contact surface with a watthour meter blade terminal inserted through a slot 464 formed between the raised center surface 462 of the spring clip 450 and the adjacent face of the jaw end 424 of the bus bar 422.

Figure 3:
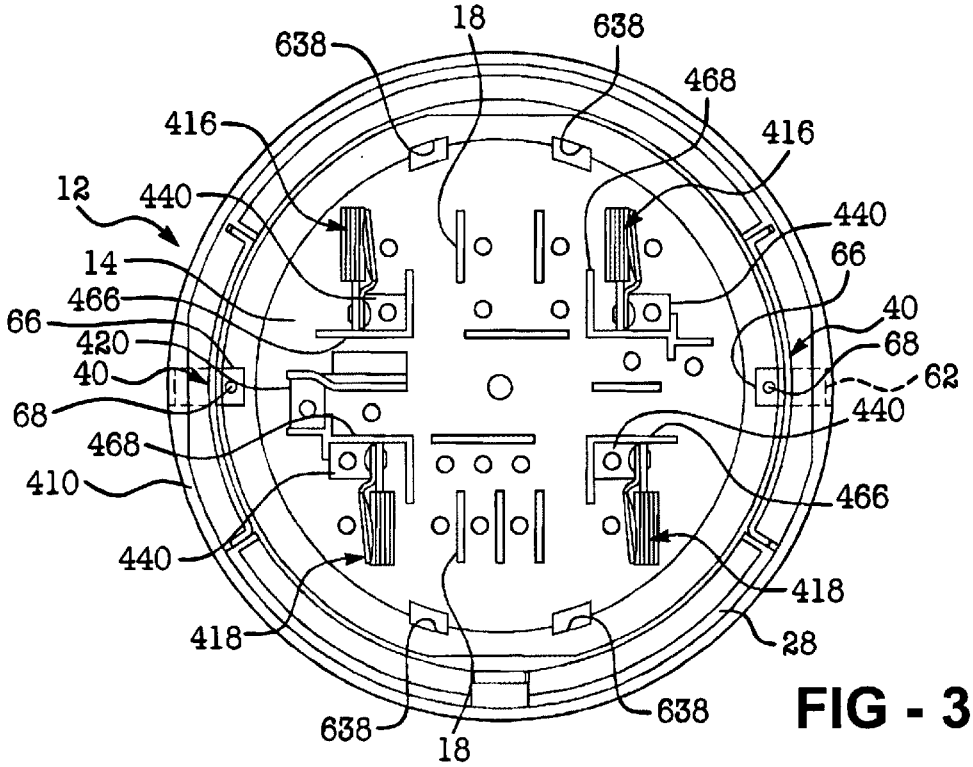
FIG. 3 is a front elevational view of the socket adapter shown in FIG. 2.
Figure 4:
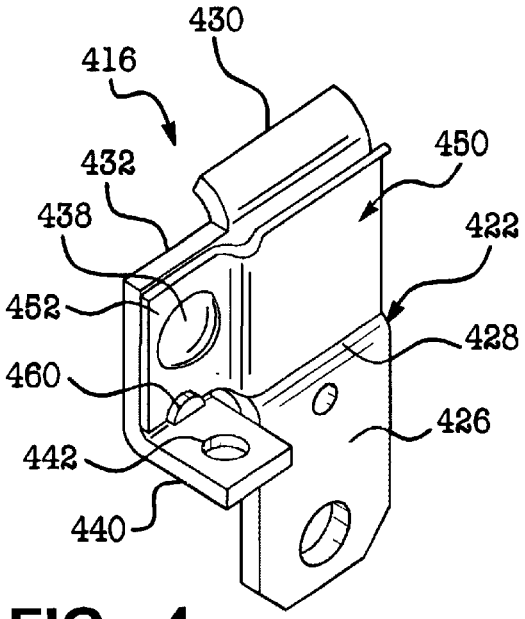
FIG. 4 is an enlarged, perspective view of one of the jaw blades shown in FIGS. 2 and 3.

Referring now to FIG. 3 there is depicted means for electrically isolating each of the line and load jaw blades 416 and 418, as well as the optional jaw blade 420, from each other. The isolating means includes a plurality of irregularly shaped brackets or flanges of two types 466 and 468, by example only. The flanges 466 and 468 are unitarily formed with the base 14 and project upwardly from the base 14 within the interior space formed between the base 14 and the sidewall 26.

The flanges 466 have a generally L-shape and are positioned to engage at least two sides of the mounting tabs 440 on one line jaw blade 416 and one load jaw blade 418. The other flanges 468 have an irregular shape with one pair of perpendicularly oriented surfaces positioned to engage two edges of the tabs 440 on one line jaw blade 416 and one load jaw blade 418. Other portions of the flanges 468 are positioned to engage the tabs 440 on the optional fifth jaw blade 420.

In this manner, when each line and load jaw blade 416 and 418 is inserted through one of the slots 18 in the base 14, the respective tabs 440 will seat on the base 14 and engage the respective flanges 466 and 468. This aids in preventing pivotal movement of each of the line and load jaw blades 416 and 418 in the respective slot 18 in the base 14.

Figure 8:
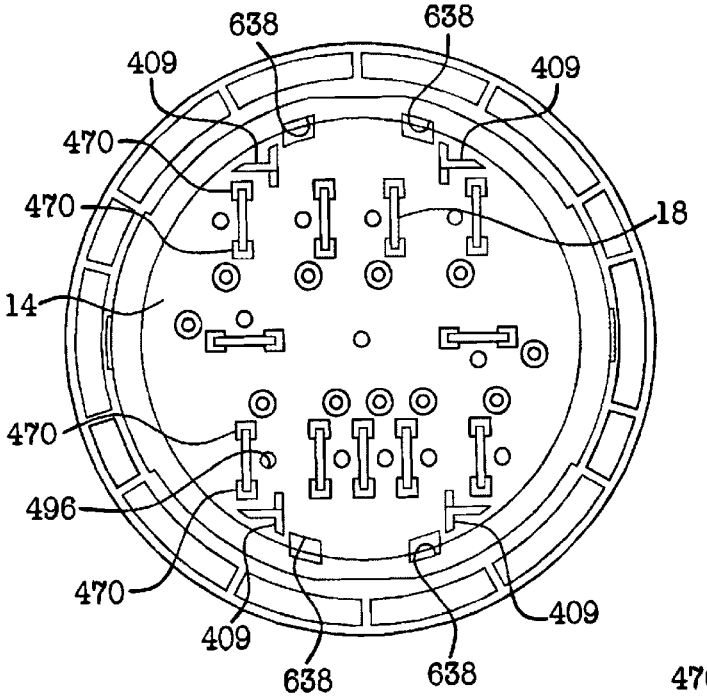
FIG. 8 is a rear elevational view of the socket adapter housing shown in FIGS. 2 and 3.
Figure 9:
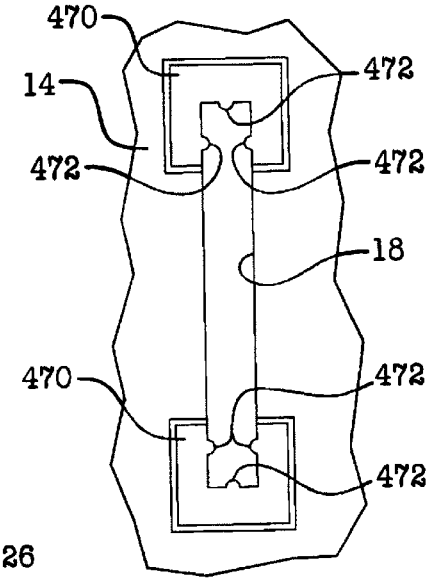
FIG. 9 is an enlarged, partial view of one of the jaw blade mounting apertures depicted in FIG. 8.

FIGS. 8 and 9 depict a rear or exterior surface of the base 14. The mounting means also includes at least one and preferably a pair of opposed U-shaped flanges 470 which are formed on the base wall 14 and disposed on opposite ends of each slot 18. Each U-shape flange 470 is positioned to engage one side edge of the blade terminal end 426 of one line or load jaw blade 416 or 418 to assist in preventing sideways pivotable movement of the jaw blade 416 or 418 in the slot 18.

The mounting means also includes at least one and preferably a plurality of bosses 472, such as three, by example only, which are unitarily formed on the base 14 in opposed ends of each jaw blade mounting slot 18. Each boss 472 extends into the slot 18 and is adapted for engaging the blade terminal end 426 of one line or load jaw blade 416 or 418 to securely fix the blade terminal end 426 in the slot 18 without movement. The bosses 472 are arranged in pairs side edge to side edge of the slot 18 or on opposite sides of the slot 18.

Referring now to FIGS. 10–12B, there is depicted a jaw contact safety shield 200 which is mountable in the socket adapter housing 12. The safety shield 200 is formed of a one-piece, electrical insulating material, such as a suitable plastic, and, when mounted in the socket adapter housing 12, substantially surrounds all of the line and load jaw blades 416, 418 and the optional jaw blade 420 within the socket adapter 10 and includes small slots allowing the insertion of one watthour meter blade terminal 13 into engagement with each line and load jaw contact 416 and 418 in the socket adapter 10.

The safety shield 200 includes a top or outer wall 202 and a plurality of sidewalls all denoted by reference number 204. A plurality of raised bosses 206 are formed on the top wall 202. The bosses 206 are positioned at the normal jaw contact positions of a watthour meter socket adapter.

Each boss 206 has an aperture or slot 208 formed therein. Each slot 208 has a top wall portion 210 extending parallel to the plane of the top wall 202 and a contiguous sidewall portion 212 forming a continuous L-shaped slot along the top wall 202 and the sidewall 204 of the safety shield 200. The provision of the side slot portion 212 simplifies the insertion or removal of the watthour meter into and out of the jaw contacts in the socket adapter through the safety shield 200.

A plurality of end flanges 216 are formed on opposite edges of the sidewall 204 and project outwardly from each adjacent sidewall 204. Each end flange 216 has a pair of downwardly depending legs 218 extending therefrom, each leg 218 terminating in an outwardly extending latch projection 220. The latch projection 220 in each leg 218 is releasibly insertable through one aperture 222 in the base wall 14 of the socket adapter housing 12 as shown in FIGS. 12A–12D.

Figure 12A:
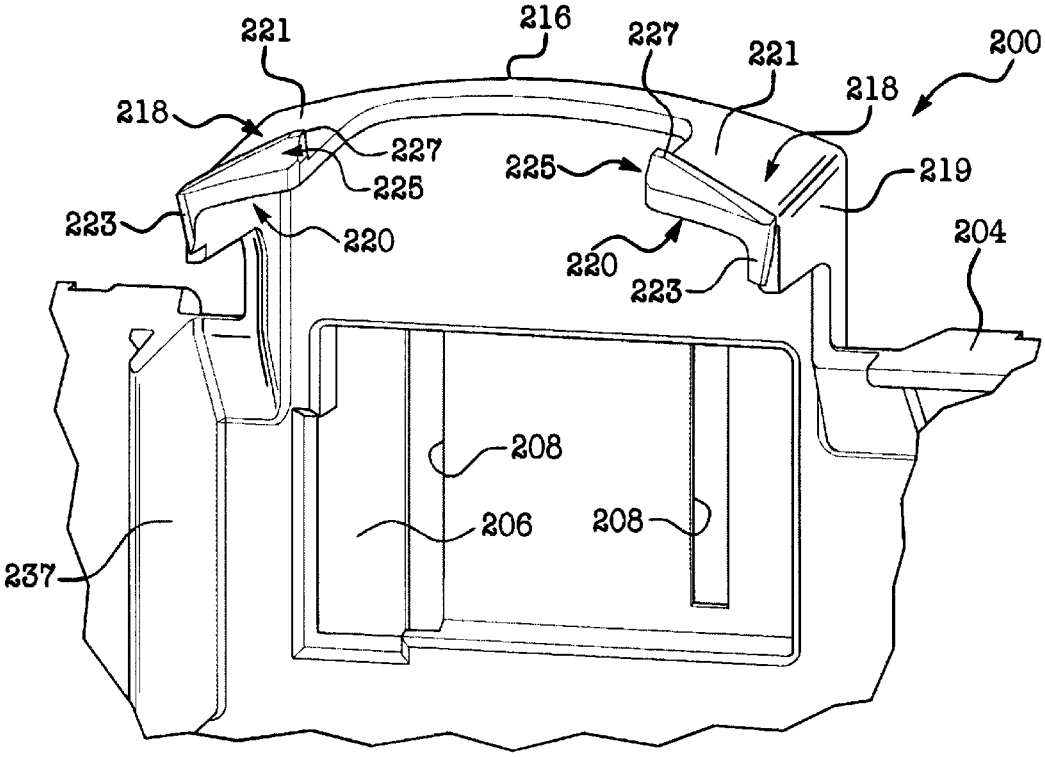
FIG. 12A is a partial, rear perspective view of the safety shield of the present invention.

Each leg 218 is formed of first and second angularly disposed leg portions 219 and 221, respectively, as shown in FIG. 12A. The first leg portion 219 terminates in a first free edge 223. The second leg portion 221 extends angularly from a common edge with the first leg portion 219, preferably at a 90° angle. The second leg portion 221 terminates in a flange 225 having a cantilevered edge 227 projecting from an end of the flange 225 common with one end of the second leg portion 221.

As shown in FIG. 12A, the flange edge 227 has a generally tapered shape extending between one end portion at the joint of the first and second leg portions 219 and 221 to a larger diameter end at the inner end of the second leg portion 221.

Since the entire safety shield 200 is formed of a plastic material, the length of the legs 218 as well as the thin nature of the flange 225 provides a degree of springiness or resiliency to the flange 225 and the end of the second leg portion 221 which enables the flange 225 to exhibit twisting movement as described hereafter.

Figure 12B:
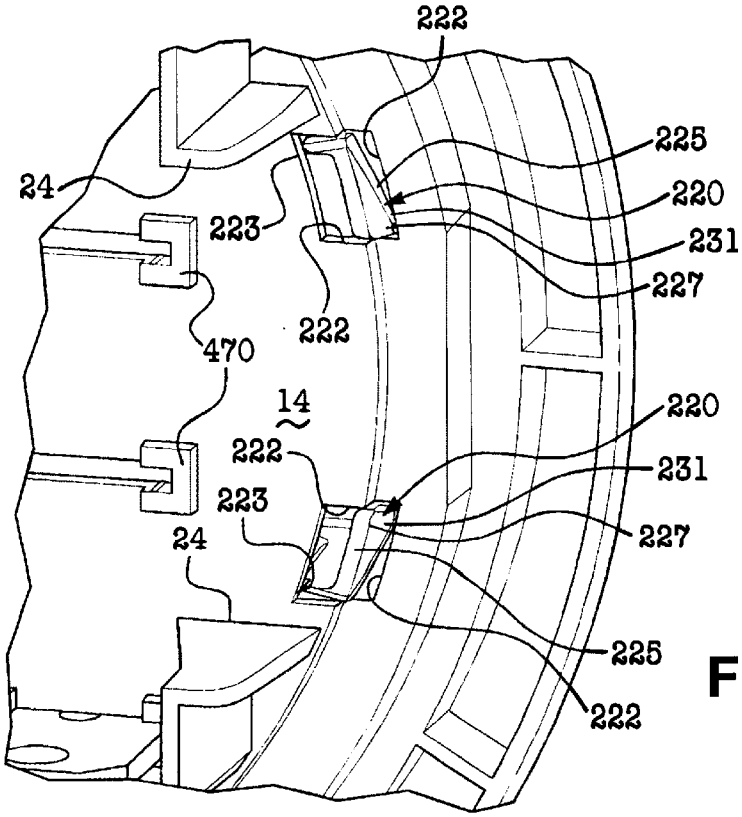
FIG. 12B is a partial, rear perspective view showing the mounting legs of the safety shield in a latched position in the watthour meter socket adapter base.

As shown on FIGS. 12B–12D, the second leg portion 221 will exhibit a degree of twisting movement as each leg 218 of the shield 220 is forcibly inserted through one of the apertures 222 in the base wall 14 of the socket adapter housing 12.

The legs 218 are inserted through the apertures 222 until the flanges 225 snap over the edge of the base wall 14 surrounding the aperture 222. In this position, as shown on FIGS. 12B and 12C, the flange edge 227 overlays and is in an engagement with a surface 231 defined by a recessed portion of the base wall 14 within the aperture 222. At the same time, the edge 223 of the first leg portion 219 of each leg 218 is in engagement with an inner edge 233 of the aperture 222.

In this manner, the edge 223 locks the leg 218 in the aperture 222 from movement at least along the length of the edge 223 which completely fills the inner dimension of the aperture 222 extending from the edge 233. Only the edge 227 of the flange 225 is capable of movement, such as a bending or twisting movement, about the juncture of the edge 223 of the first leg portion 219 and the flange 225 on the end of the second leg portion 221. Force exerted in the direction of arrow 235, shown in FIG. 12D, will result in a twisting or bending movement of the edge 227 of the flange 225 until the flange 225 clears the surface 231 thereby enabling the entire leg 218 to be separated from the aperture 222.

The combination of the complete filing of the width of the aperture 225 by the edge portion 223 of the first leg portion 219 of each leg 218 as well as the snap-over engagement of the flange 225 on the second leg portion 221 of each leg 218 locks the safety shield 200 to the base wall 14 of the socket adapter housing 12.

This locking resists separation of the legs 218 of the safety shield 200 from the base wall 14 during removal of a watthour meter through the apertures in the shield. At the same time, however, once the socket adapter housing 12 has been separated from the watthour meter socket, bending force in the direction of arrow 235 in FIG. 12D may be employed to release each leg 218 from the base wall 14 to separate the safety shield 200 from the base wall 14.

As also shown in FIG. 12A, an electrically insulating barrier, such as a flange 237, is integrally formed with and projects from a rear surface of the safety shield 200, and is formed on the safety shield 200 in at least one or more locations, preferably adjacent to an aperture in the safety shield 200 which is adapted to be disposed adjacent the line and load jaw contacts 416 and 418 in the socket adapter housing 12. The insulating barrier 237 electrically isolates the high electric potential jaw contacts from any adjacent circuitry or components mounted within the socket adapter housing and covered by the safety shield 200.

Figure 10:
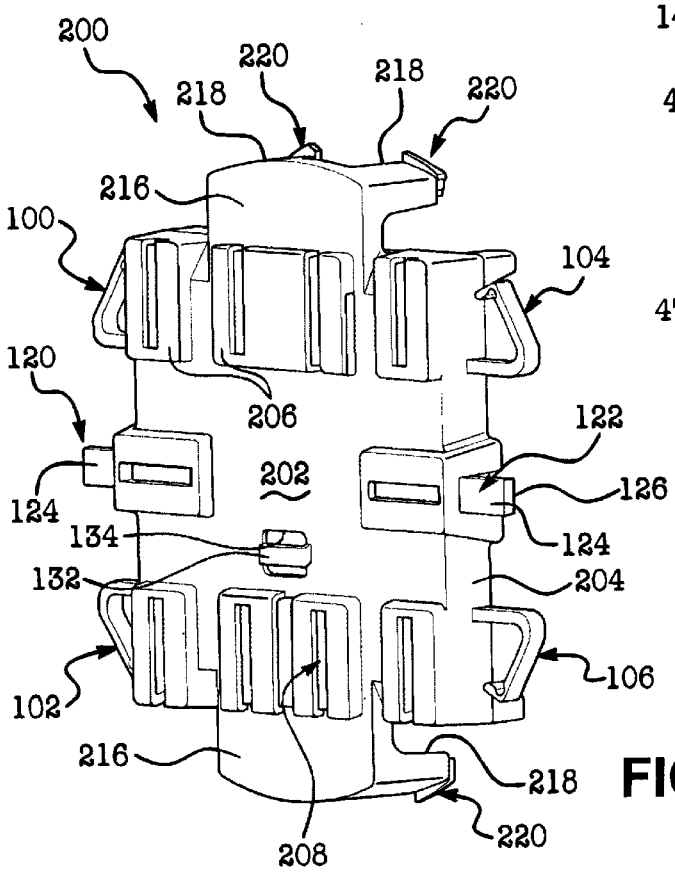
FIG. 10 is a perspective view of the safety shield shown in FIG. 1.
Figure 11:
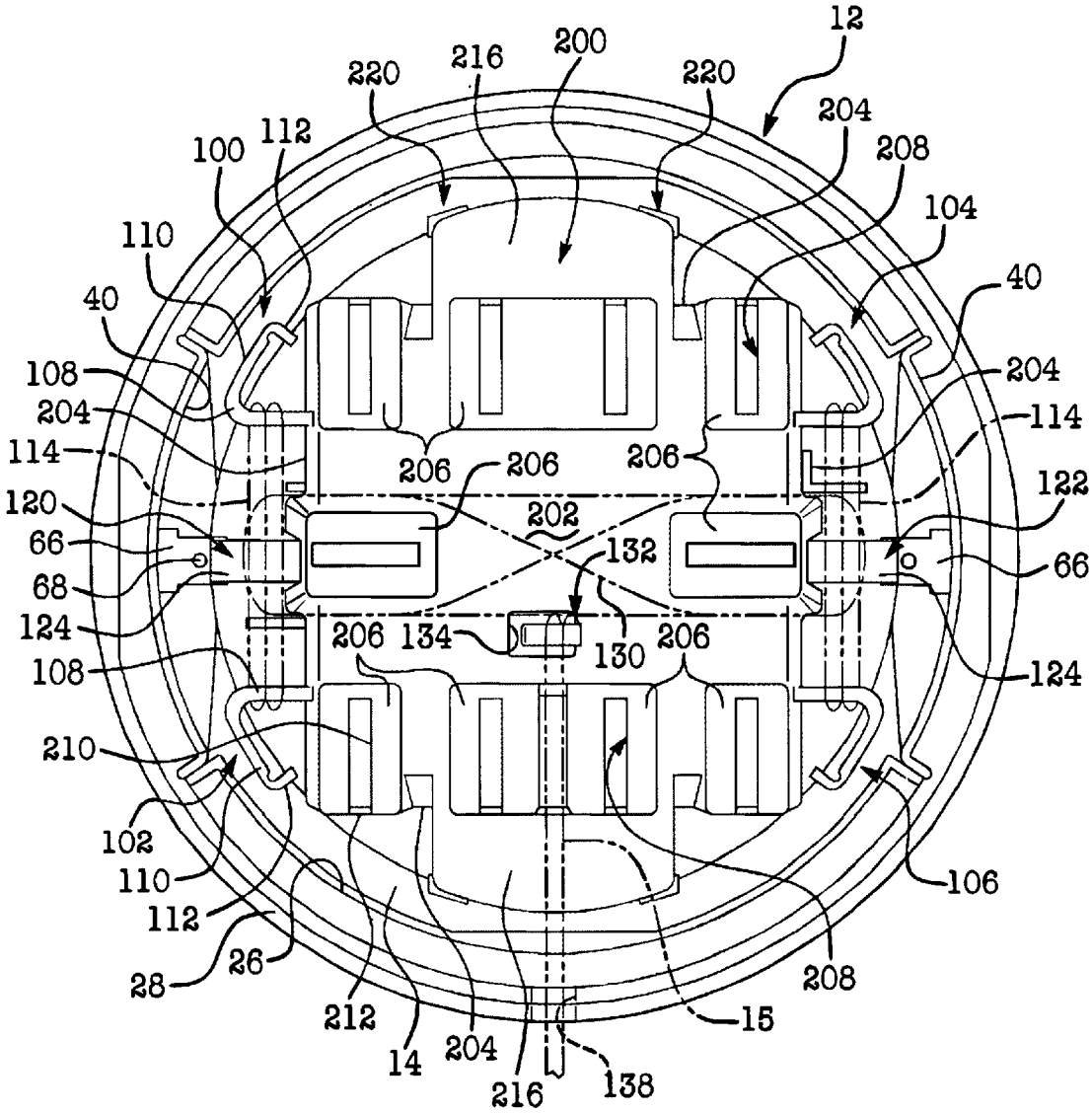
FIG. 11 is a front elevational view of the assembled safety shield and the socket adapter shown in FIG. 1.

As shown in FIGS. 10 and 11 there is depicted a wire guide or wire wrap means formed integrally on the safety shield 200 for providing a winding surface for the cables or conductors 15 attached to the watthour meter 11 when the watthour meter 11 is mounted in the socket adapter housing 12.

In one aspect of the safety shield 200, at least one pair of spaced, opposed wire guides 100 and 102 are integrally formed on opposite sidewalls 204 of the safety shield 200, preferably adjacent the sidewalls 204, from which the flanges 216 project. An optional second pair of wire guides 104 and 106 are also formed on the same sidewalls 204, but adjacent the opposed intervening sidewall 204 from which the opposed flange 216 extends.

The wire guides 101, 102, 104, and 106 may take any conventional shape, but are preferably in a hook-like shape to provide a surface or edge about which the watthour meter cable is can be easily wound in a variety of back and forth or criss-cross patterns over the safety shield 200. By way of example only, each wire guide 100, 102, 104 and 106 has an arm-like shape formed of a first leg 108 projecting from one sidewall 204 of the safety shield 200, a second leg 110 angularly disposed, preferably at an acute angle, from the first leg 108, and an outer tip 112. The outer tip 112 is disposed at an angle to the second leg 110, preferably at a 90° angle. The outer end of the tip 112 is spaced from the adjacent sidewall 204 of the safety shield 200 to provide an opening for insertion of the watthour meter cable 15 is therethrough.

Preferably, the distance between the end of the tip 112 and the sidewall 204 is smaller than the diameter of the wires or conductors 15. The spring or resilient nature of the arms 100, 102, 104 and 106 enables the tip 112 to move away from the sidewall 204 for insertion of the wire 15 into the interior space defined by the arm and the sidewall 204. However, the tip 112 springs back to trap and hold the wire 15 in the interior space.

As shown by the phantom lines 114, any watthour meter cable or cables 15 can be wound around the first legs 108 of each pair of wire guides 100 and 102, and/or 104 and 106. The second legs 110 and the tips 112 of each wire guide 100, 102, 104 and 106 act as protectors for retaining the wrapped cables 15 in position about the opposed wire guides 100 and 102 or 104 and 106.

It will be noted that this winding arrangement and the position of the wire guides 100, 102, and 104, 106 in opposed pairs on opposite sides of the safety shield 10 disposes the wrapped or wound watthour meter cables 15 outside of the watthour meter blade terminals 13 and meter feet 409 thereby preventing any pinching or breaking of the cable 15 during insertion of the blade terminals 13 of the watthour meter 11 through the slots 208 in the safety shield 200.

The wire guide feature of the present safety shield 200 in another aspect shown in FIGS. 10 and 11 can be embodied in opposed flanges 120 and 122 which project laterally outward from opposed sidewalls 204 of the safety shield 200, generally along the sidewalls 204 extending between the end flanges 216. The flanges 120 and 122 include a leg 124 which projects laterally outward from one of the sidewalls 204 and a depending outer leg or tip 126 which projects angularly from the outer end of the first leg 124, such as generally perpendicular therefrom. The tip 126 functions to retain the wire(s) 15 within the confines of the flanges 120, 122 and the adjoining sidewall 204 of the safety shield 200.

As shown in FIG. 11, the watthour meter cable 15 may be wound in a figure eight and/or oval pattern 130 about the flanges 120 and 122 and the adjacent bosses 206 on the top wall 202 of the safety shield 200. This arrangement ensures that the cable 15 is not disposed in a position which would be pinched or broken by insertion of the watthour meter blade terminals 13 through the slots 208 in the bosses 206 of the safety shield 200.

The wire guide, in another aspect, is in the form of one or more clips, each denoted in one aspect by reference number 132 in FIG. 11. The clip 132 is in the form of a flange projecting laterally across the top wall 202 of the safety shield 200 over an aperture 134 formed in the top wall 202. The aperture 134 extends through the top wall 202 and allows the passage of a telephone wire or cable 15 therethrough. The telephone cable 15 enters the interior of the socket adapter housing 12 through an aperture 138 in the sidewall 26 of the socket adapter housing 12. The telephone cable 15 is wound in a plurality of turns about the clip 132 which acts as a strain relief for the telephone cable 15.

FIG. 13 depicts another aspect of a clip 140 which includes at least one and preferably two spaced clip members 142 and 144. Each clip member 142 and 144 is formed over a first leg 146 projecting upwards from the top wall 202 of the safety shield 200 and an inward turned top leg 148 which terminates in an inner end 150 facing the inner end 150 of the opposed clip member 142 and 144. A small slot is formed between the opposed inner end 150 for insertion of the cable 15 therethrough, after the cable is shown in FIG. 11 enters the socket adapter housing 12 through the aperture 138 in the sidewall 26. The wire or cable 15 may be wrapped in a number of turns around either clip member 142 or 144 for strain relief purposes before passing between the bosses 206 to an aperture in the top wall 202 of the safety shield 10, such as the aperture 134 shown in FIG. 3.

Figure 14:
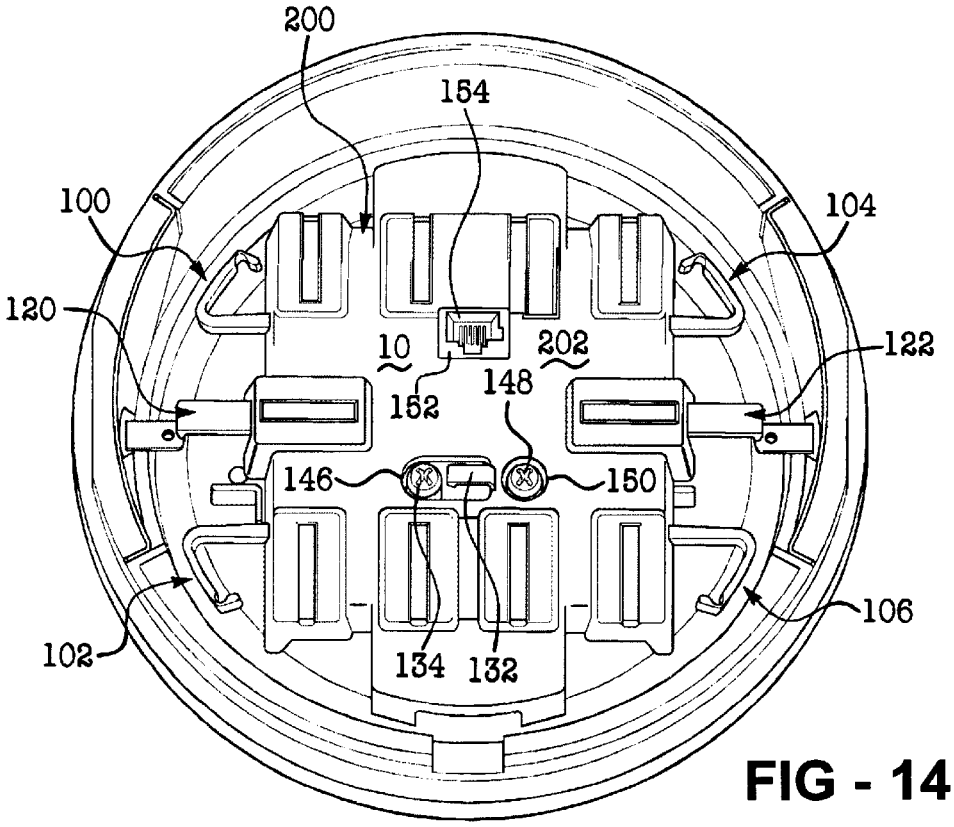
FIG. 14 is a perspective view of another aspect of the watthour meter socket adapter safety shield according to the present invention.

FIG. 14 depicts a modification to the safety shield 200 which, except as described hereafter, has essentially the same construction as the safety shield 200 shown in FIG. 11. Thus, only the differences between the safety shield shown in FIGS. 11 and 13 will now be described in detail.

As shown in FIG. 14, the aperture 134 in the top wall 202 of the safety shield 200 is offset from the longitudinal center of the safety shield 200 thereby providing an enlarged space adjacent one end beyond the end of the clip 132 to provide access to a telephone terminal 146 mounted on a telephone connector 147 on the base 14 of the socket adapter housing 12, as shown in FIGS. 1 and 2. An additional aperture 148 is disposed adjacent to the flange 132 in the top wall 202 of the safety shield 200 and exposes a second telephone terminal 150 on the connector 147 . In this manner, the ring and tip wires of a conventional telephone cable 15 extending from the watthour meter 11 may be brought through the aperture 138 in the sidewall 26 of the socket adapter housing 12 as shown in FIG. 11 and then individually secured to the terminals 146 and 150 without removing the safety shield 10 from the socket adapter housing 12.

In addition, an aperture 152 is also formed in the top wall 202 and exposes or receives a conventional telephone jack 154 in the connector 147 for receiving a mating telephone connector 17 on the cable 15 extending from the watthour meter 11. This arrangement simplifies the connection of the telephone cable 15 extending from the watthour meter 11 by enabling the socket connections to the telephone terminals 146 and 150 to be made prior to mounting the watthour meter 11 in the socket adapter housing 12. In addition, as the watthour meter 11 is brought into proximity with the socket adapter 12, the telephone connector 17 on the cable is extending outward from the watthour meter 10 may be easily plugged into the jack 154 and the excess telephone cable 15 wrapped about the clip 132 or any of the other wire guides 100, 102, 104 and 106 or flanges 120 and 122 to conveniently take up any excess telephone cable 15 without interference with watthour meter blade terminals 13 or the meter feet 409.

Figure 15:
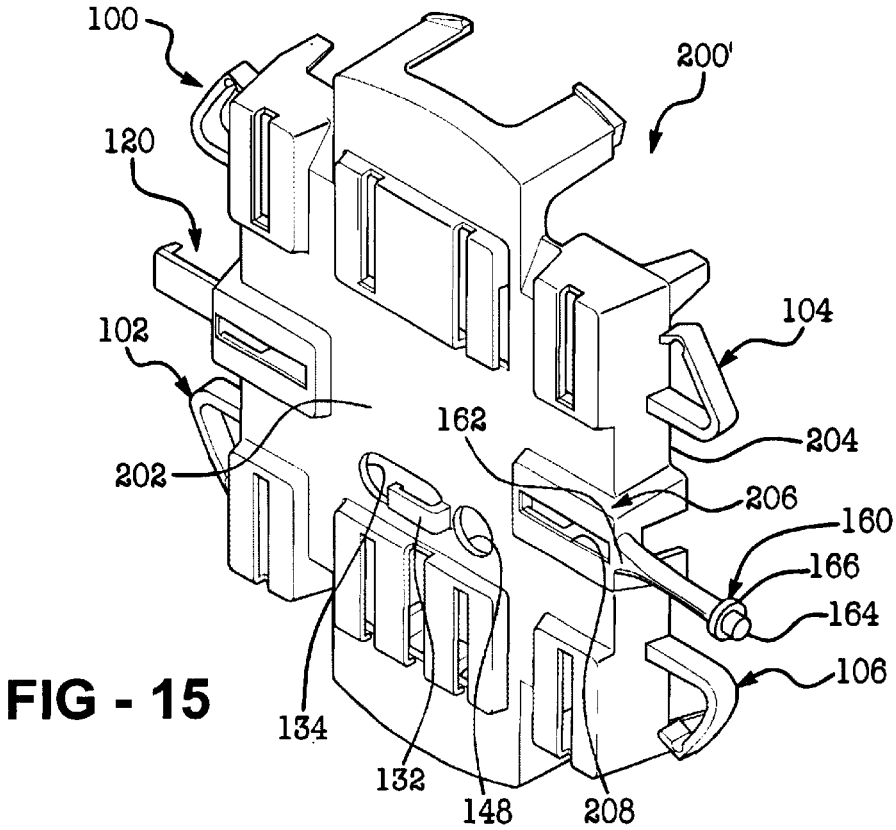
FIG. 15 is a perspective view of yet another aspect of a watthour meter socket adapter safety shield according to the present invention.
Figure 16:
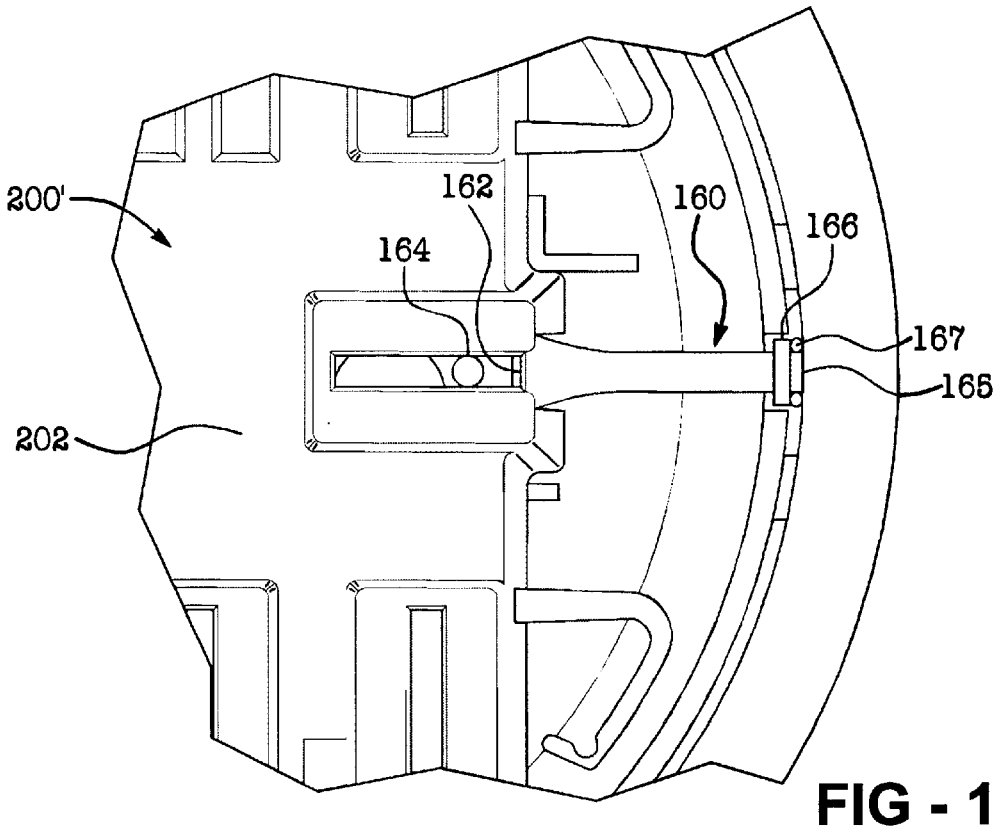
FIG. 16 is a partial, enlarged, front elevational view of the safety shield shown in FIG. 15 mounted in a watthour meter socket adapter.
Figure 17:
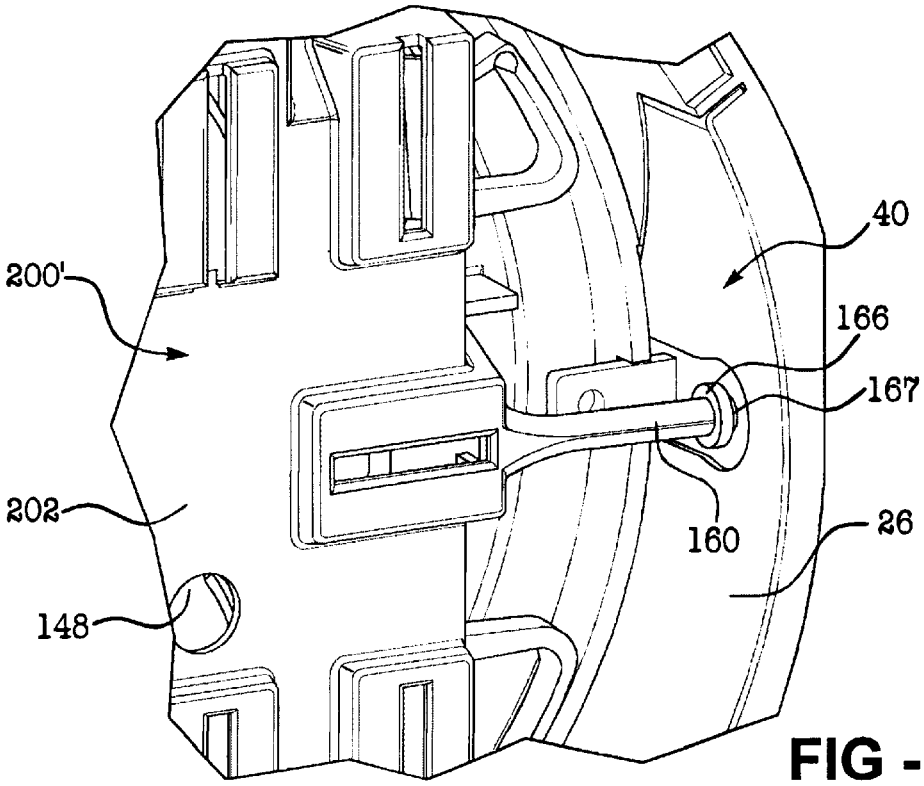
FIG. 17 is a partial perspective view of the safety shield socket adapter shown in FIG. 15.

FIGS. 15, 16 and 17 depict another aspect of a watthour meter safety shield referred to by the reference number 200'. Due to the substantial number of similar features between the safety shield 200 shown in FIG. 10 and the safety shield 200' shown in FIG. 15, only the differences between of the two safety shields 200 and 200' will be described in detail hereafter.

The safety shield 200' is provided with a light transmitting means or guide, also known as a "light pipe" 160 which guides light generated internally within the socket adapter housing 12, such as by an illuminatable light source 164 (FIG. 16) on a circuit element mounted within the socket adapter housing 12 within the confines of the safety shield 200', to an external, more readily visible location, such as the location which is visible externally of the joined watthour meter 11 and the watthour meter socket adapter housing 12. The light pipe 160 is also capable of transmitting light generated externally of the socket adapter housing 12 to light responsive components mounted internally within the housing 12, such as light detectors used in optical communication circuitry. At the same time, the light source 164 within the housing 12 may be an optical data communication source, such as an LED, which generates illuminated pulses of light in the form of a digital code which is transmitted by the light pipe 160 to the externally mounted end of the light pipe 160 for viewing or communication to a light responsive programmer device operated by a utility service person.

The light pipe 160 is formed of a light transmissive material, such as a transparent, plastic. Preferably, where the entire safety shield 200' is formed of a transparent plastic, the light pipe 160 is integrally molded with the safety shield 200' as a unitary part of the safety shield 200'.

Alternately, the light pipe 160 can be a separate transparent plastic member mounted by suitable fasteners or heat welding to the remainder of the safety shield 200'.

The light pipe 160 has a first end 162 which is disposed adjacent the side edge of one slot 208 in one of the bosses 206, such as the boss 206 disposed along one of the sidewalls 204 at the sixth watthour meter jaw contact position. The first end 162 of the light pipe 160 is open or exposed to ambient so as to receive light generated beneath the safety shield 200', such as by an LED 164 shown in FIG. 16 which is mounted on a circuit board carried within the socket adapter housing 12. Alternately, the first end 162 of the light pipe 160 may be disposed in close proximity to or even optically coupled to a light responsive device, such as a light responsive diode, to transmit light generated externally of the housing 12 by the light pipe 160 to the light responsive device.

The light pipe 160 has a second end 165. A collar 166, shown by example only, is disposed adjacent to the second end 165 and serves as a seat for a seal member or O-ring 167 which is disposed in proximity to the sidewall 26 of the socket adapter housing 12 as shown in FIGS. 16 and 17.

The collar 166 applies a compressive force on the seal or O-ring 167 to push and hold the seal 167 into sealing engagement with the sidewall 26 surrounding the aperture. In this position, the second end 165 of the light pipe 160 extends exteriorly through or is visible exteriorly through the aperture in the sidewall 26. In this manner, the second end 165 is visible externally of the sidewall 26 of socket adapter housing 12 so as to provide an indication of the illumination state of the illuminated device, such as the LED 164, for whatever function the LED 164 serves in the circuit mounted within the socket adapter housing 12. Examples of such a circuit include a blown or open surge suppression device, a watthour meter tampering indicator, etc.

In addition, the second end 165 is communicable externally of the sidewall 26 of the socket adapter housing 12 so as to receive light generated externally of the housing 12, such as by an optical programmer which is coupled to the second end 165 of the light pipe 160.

As also shown in FIG. 17, the second end 165 of the light pipe 160 is disposed through an aperture in the surge ground suppression member 40 so as not to interfere with the function of the surge suppression member.

Although the light pipe 160 replaces one of the intermediate flanges which form the intermediate wire guides 124 and 126, the light pipe 160 can act as a replacement for the wire guide flange 126 by wrapping a cable 15 about the light pipe 126 and the opposed wire guide 124 in the same manner as described above and shown in phantom in FIG. 11.

Figure 18:
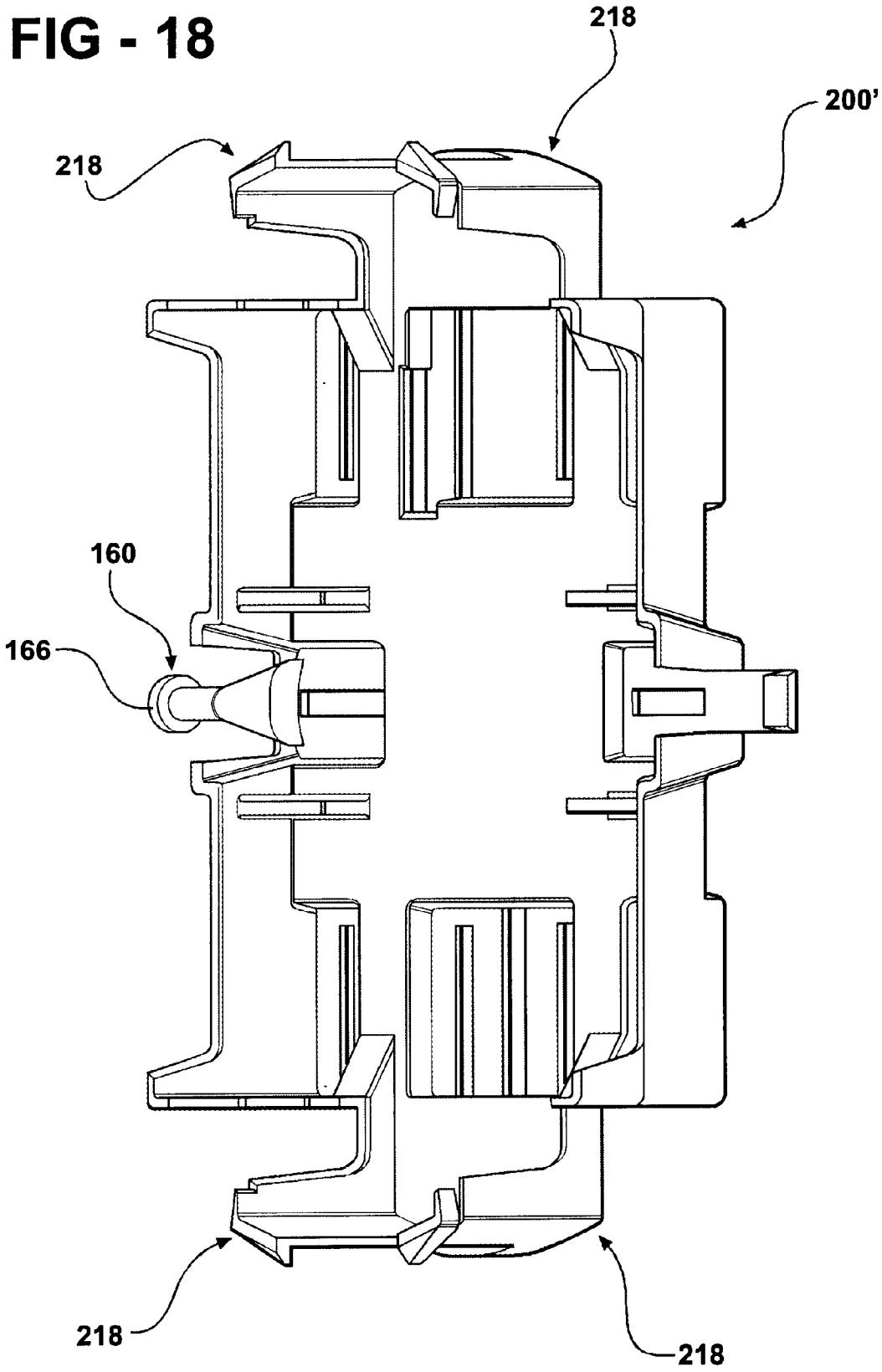
FIG. 18 is a rear perspective view of a modified safety shield with a light guide, but without wire guides.

FIG. 18 depicts a modified safety shield 200' which includes the light pipe 160 but lacks any wire guides 100, 102, 104, 106, 120, 132, 134 or 140. The inner end of the light pipe 160 is clearly depicted in FIG. 17. Other elements of the shield 200' are identical to those described early and shown in FIGS. 1–16.

Figure 19:
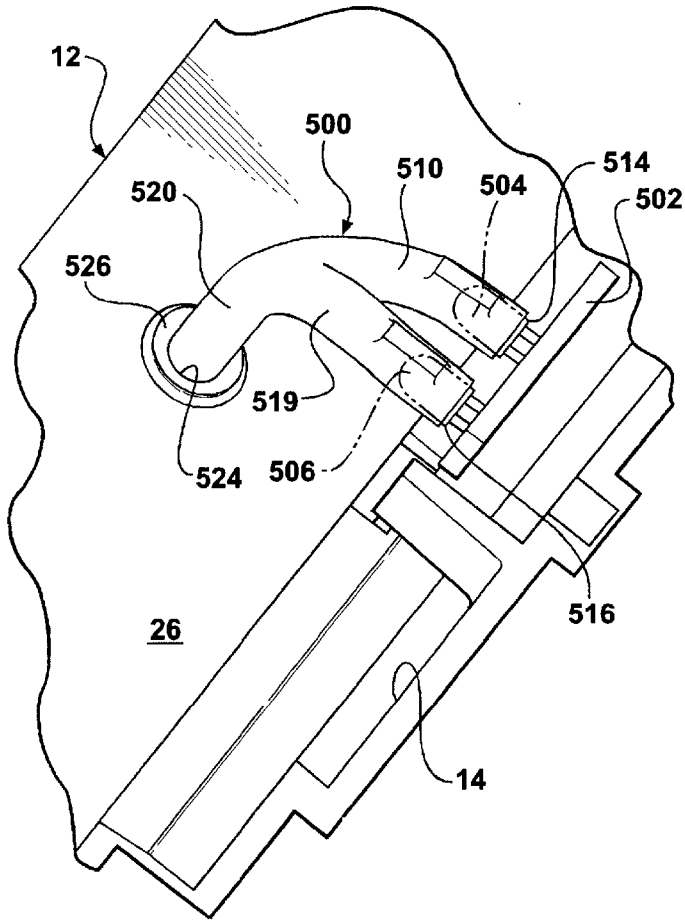
FIG. 19 is an enlarged, partial, perspective view of another aspect of a light transmissive guide according to the present invention.
Figure 20:
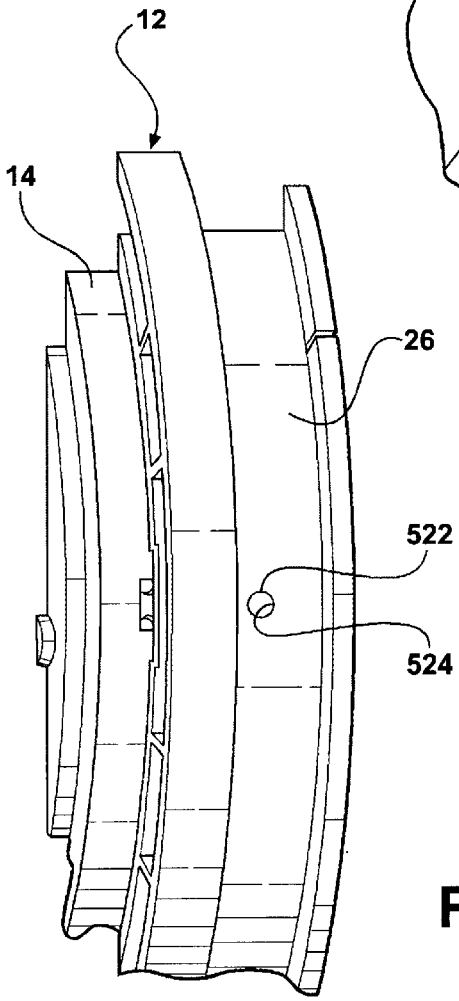
FIG. 20 is a side elevational view of an electrical service apparatus having the outlet end of the light transmissive guide of the present invention visible exteriorly of the housing.

Referring now to FIGS. 19 and 20, there is depicted another aspect of a light transmissive means or guide 500 according to the present invention in which the light transmissive means or guide, hereafter referred to as the "light pipe 500" is a separate, distinct element from the safety shield so as to enable its use with or without the safety shield 200.

In this aspect, a light source support 502, such as in the exemplary form of a printed circuit board is mounted in a fixed position within the housing 12, such as being mounted directly on the base 14 of the housing 12. In this aspect of the invention, the individual light sources are depicted as separate light emitting diodes (LEDs) 504 and 506 which are electrically connected to traces or other circuit elements on the circuit board 502.

The light pipe 500 has a plurality of inner ends, such as first and second inner ends 510 and 512, respectively, by way of example only. The end portion 514 and 516 of each of the inner ends 510 and 512, respectively, is disposed in light transmission in arrangement with the light sources 504 and 506. This light transmissive arrangement can be made by contacting the ends 514 and 516 with the light sources 504 and 506.

Alternately, as shown by example in FIG. 19, at least the end portion 514 or 516 each of the inner ends 510 and 512 is hollow or has a hollow recess extending from an open end which is adapted to fit over the light sources 504 and 506. This fit can be a snap fit based on suitable dimensions between the inner ends 514 and 516 in the outer surface of the light sources or LEDs 504 and 506.

The two inner ends 510 and 512 merge into a single outlet end 520. The separate inner ends 510 and 512 and the single outer end 520 may be integrally formed, such as by molding or casting into a single, unitary light pipe or guide. Alternately, one of the inner ends, such as inner end 510 may be spliced or otherwise joined to a continuous section forming the inner end 512 and the outer end 520.

As shown in FIG. 19, the distal end 522 of the outer end 520 is externally communicable or visible through an aperture 524 in the sidewall 26 of the housing 12. The outer end 522 can be held in position in or immediately adjacent to the aperture 524 by means of fasteners or other suitable mounting arrangement. Alternately, the outer end 522 can be snap fit by use of suitable dimensions in the aperture 524 to physically connect the outer end 520 to the aperture 524. A seal means 526, such an O-ring 526, shown in FIG. 18, is mounted about the outer end 520 in contact with the sidewall 26 to seal the aperture 524 and the outer end 522 of the outer end 520 of the light pipe 500 extending therethrough.

It will be understood that the light pipe or guide 500 can also be formed with a single inner end 510 and the single outer end 520. This arrangement provides communication of the state of the light source 504 externally of the housing 12 as well as providing bidirectional data communication via light-based signals through the light pipe 500.

The dual inner end light pipe 500 shown in FIG. 18 may also be employed for bidirectional data communication as long as the light receptive elements forming the light source 504 and 506 are distinguishable by different wavelengths, frequencies or other differentiating means to enable signals passed through the outer end 520 to be processed by only one light receptor 504 or 506 despite being received by both light receptors or sources 504 and 506.

In summary, there has been disclosed a unique light transmissive means which enables the light from or to light generating or receiving elements mounted within a socket adapter housing to be directed to or received from a more easily visible location, such as external of the socket adapter housing, to provide an indication of the occurrence of a circuit event during operation of the watthour meter or to transmit data on the form of light pulses into the housing.

The light transmissive means or guide is a separate element mountable separately within the housing of an electrical service apparatus, such as a watthour meter socket adapter. Alternately, the light transmissive means may be formed as an integral part, or as a separate part which is attached to a jaw contact safety shield, so as to enable its mounting in the housing of an electrical service apparatus concurrently in the same manufacturing step as the mounting of the jaw contact safety shield in the housing.

What is claimed is:

1. An electrical power service apparatus comprising:

a housing with a base wall and an annular sidewall extending from the base wall;

a plurality of electrical contacts carried on the base wall a portion of the contacts projecting externally of the housing;

at least one light source carried in the housing; and a light transmissive element, disposed in the housing and having a plurality of first ends and a second end disposed in light communication, the light transmissive element transmitting light internally between at least one of the first ends and the second end, at least one of the first ends, disposed adjacent to the at least one light source, the second end disposed to be visible externally of the housing.

2. The electrical power service apparatus of claim 1 wherein the light transmissive element comprises:

pair of first end portions, each terminating in one of the first ends, a single second end portion terminating in the single second end; and the pair of first end portions integrally extending into the single second end portion.

3. The electrical service apparatus of claim 1 further comprising:

an aperture formed in the sidewall of the housing; and the second end of the light transmissive means visibly disposed through the aperture in the sidewall of the housing.

4. The electrical service apparatus of claim 3 further comprising:

means for sealing the light transmissive means to the sidewall of the housing.

5. The electrical service apparatus of claim 4 further comprising:

a collar formed on the light transmissive means for biasing the seal into sealing engagement with the sidewall of the housing.

6. The electrical service apparatus of claim 1 wherein, the light source is a light responsive element; and at least one of the first ends of the light transmissive element is disposed in light communication with the light responsive element disposed in the housing;

an aperture formed in the sidewall of the housing; and the second end of the light transmissive element mounted in the aperture.

7. The electrical service apparatus of claim 6 wherein:

the second end of the light transmissive means is snap mounted in the aperture in the sidewall of the housing.

8. The electrical service apparatus of claim 6 wherein:

at least one of the first ends of the light transmissive element snaps onto the light responsive element.

9. The electrical service apparatus of claim 6 further comprising:

an electrically insulating shield for covering the electrical contacts within the housing, the shield having apertures alignable with at least one electrical contact adapted for receiving a blade terminal of a watthour meter in engagement with the one electrical contact.

10. An electrical service apparatus a housing with a base wall and an annular sidewall extending from the base wall;

a plurality of electrical contacts mounted on the base wall;

an electrically insulating shield for covering the electrical contacts within the housing, the shield having apertures alignable with at least one electrical contact adapted for receiving a blade terminal of a watthour meter in engagement with the one electrical contact;

a light transmissive element, disposed in the housing and having first and second ends, for transmitting light between the first and the second ends, the second end disposed to be visible externally of the housing;

the first end of the light transmissive element is disposed in light communication with a light responsive element disposed in the housing;

an aperture formed in the sidewall of the housing; and the second end of the light transmissive element mounted in the aperture, the light transmissive element being monolithically formed with the shield.

11. An electrically insulating safety shield for mounting in an electrical power service apparatus having a housing with a base wall and an annular sidewall extending from the base wall, and a plurality electrical contacts mounted on the base wall and adapted for releasibly receiving the blade terminals of a watthour meter, the safety shield comprising:

an electrically insulating body having a top wall sized to cover electrical contacts in an electrical power service apparatus;

a plurality of apertures formed in the top wall of the body alignable with at least one electrical contact in a housing, the apertures adapted for receiving a blade terminal or a watthour meter therethrough into engagement with the one electrical contact in the housing; and a light transmissive element, carried on the body and having first and second ends, the light transmissive element, transmitting light from the first end to the second end, the second end disposed to be visible externally of the housing when the body is mounted in the housing.

12. An electrically insulating safety shield for mounting an electrical service apparatus having a housing with a base wall and an annular sidewall extending from the base wall, and a plurality electrical contacts mounted on the base wall and adapted for releasibly receiving the blade terminals of a watthour meter, the safety shield comprising:

an electrically insulating body having a top wall;

a plurality of apertures formed in the top wall of the body alignable with at least one electrical contact in a housing, the apertures adapted for receiving a blade terminal of a watthour meter therethrough into engagement with the one electrical contact in the housing; and a light transmissive element carried on the body of the safety shield and having first and second ends, the light transmissive element transmitting light between the first end to the second ends, the second end disposed to be visible externally of the housing when the body is mounted in the housing, the light transmissive element monolithically formed with the shield.

13. The safety shield of claim 12 further comprising:

an aperture formed in the sidewall of the housing;

the second end of the light transmissive means visibly disposed through the aperture in the sidewall at the housing.

14. The safety shield of claim 13 further comprising:

a seal mounted on the light transmissive means and engaged with the sidewall of the housing for sealing the aperture in the housing.

15. The safety shield of claim 14 further comprising:

a collar formed on the light transmissive means for biasing the seal into sealing engagement with the sidewall of the housing.

16. The electrical service apparatus of claim 11 wherein:

the first end of the light transmissive element is disposed in light communication with a light operative element disposed in the housing;

an aperture formed in the sidewall of the housing; and the second end of the light transmissive element mounted in the aperture.

17. The electrical service apparatus of claim 16 wherein:

the second end of the light transmissive means is snap mounted in the aperture in the sidewall of the housing.

18. The electrical service apparatus of claim 16 wherein:

the first end of the light transmissive means snaps onto the light operative elements.

* * * * *